US007155156B2

(12) United States Patent
Tsueda et al.

(10) Patent No.: US 7,155,156 B2
(45) **Date of Patent: *Dec. 26, 2006**

(54) FIXING APPARATUS

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/078,726

(22) Filed: Mar. 14, 2005

(65) Prior Publication Data

US 2006/0204294 A1 Sep. 14, 2006

(51) Int. Cl.
*G03G 15/20* (2006.01)

(52) U.S. Cl. ..... 399/330; 399/333; 399/334

(58) Field of Classification Search ..... 399/330, 399/333, 328

See application file for complete search history.

(56) References Cited

U.S. PATENT DOCUMENTS 5,450,181 A * 9/1995 Tsukida et al. ..... 399/322
5,532,808 A * 7/1996 Saito et al. ..... 399/333
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,169,871 B1 * 1/2001 Higaya ..... 399/330
6,337,969 B1 1/2002 Takagi et al.
6,340,810 B1 * 1/2002 Yokoyama et al. ..... 219/619
6,415,128 B1 7/2002 Takagi et al.
6,438,335 B1 8/2002 Kinouchi et al.
6,643,476 B1 11/2003 Kinouchi et al.
6,643,491 B1 11/2003 Kinouchi et al.
6,690,907 B1 * 2/2004 Lee ..... 399/330
6,709,373 B1 * 3/2004 Park ..... 492/56
6,724,999 B1 4/2004 Kikuchi et al.
6,725,000 B1 4/2004 Takagi et al.
6,763,206 B1 7/2004 Kinouchi et al.
6,861,627 B1 3/2005 Wasai et al.
6,861,630 B1 3/2005 Kinouchi et al.
6,868,249 B1 3/2005 Kinouchi et al.
6,871,041 B1 3/2005 Takagi et al.

(Continued)

FOREIGN PATENT DOCUMENTS

JP 10-31381 A 2/1998

(Continued)

OTHER PUBLICATIONS

U.S. Appl. No. 10/378,859, filed Mar. 5, 2003, Sone et al.

(Continued)

*Primary Examiner*—David M. Gray
*Assistant Examiner*—Bryan Ready
(74) *Attorney, Agent, or Firm*—Foley & Lardner LLP

(57) ABSTRACT

A fixing apparatus according to the invention is provided with a heating roller 2 including an elastic member 2*b* and a metal conductive layer 2*c*. The elastic member has a greater outer diameter at its end portions than at its central portion. At least one air hole 100 is formed through the metal conductive layer 2*c* at a predetermined position opposing the small-diameter central portion of the elastic member. The air hole connects the outside to a clearance formed between the elastic member 2*b* and the metal conductive layer 2*c*.

18 Claims, 4 Drawing Sheets

U.S. PATENT DOCUMENTS

| | | | | |
|---|---|---|---|---|
| 6,889,018 | B1 | 5/2005 | Kinouchi et al. | |
| 6,898,409 | B1 | 5/2005 | Tsueda et al. | |
| 6,900,419 | B1 | 5/2005 | Takagi et al. | |
| 6,957,036 | B1 * | 10/2005 | Kikuchi et al. | 399/333 |
| 6,992,272 | B1 * | 1/2006 | Kitano et al. | 219/619 |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |
| 2005/0185995 | A1 * | 8/2005 | Akita et al. | 399/328 |

FOREIGN PATENT DOCUMENTS

| | | | |
|---|---|---|---|
| JP | 2001-215833 | A | 8/2001 |

OTHER PUBLICATIONS

U.S. Appl. No. 10/799,770, filed Mar. 15, 2004, Kikuchi et al.
U.S. Appl. No. 10/805,305, filed Mar. 22, 2004, Sone et al.
U.S. Appl. No. 10/805,308, filed Mar. 22, 2004, Tsueda et al.
U.S. Appl. No. 10/805,420, filed Mar. 22, 2004, Sone et al.
U.S. Appl. No. 10/805,507, filed Mar. 22, 2004, Kikuchi et al.
U.S. Appl. No. 10/805,514, filed Mar. 22, 2004, Kinouchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/820,138, filed Apr. 8, 2004, Sone et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/945,395, filed Sep. 21, 2004, Kinouchi et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/080,833, filed Mar. 16, 2005, Tsueda et al.
U.S. Appl. No. 11/082,218, filed Mar. 17, 2005, Tsueda et al.

* cited by examiner

FIXING APPARATUS

BACKGROUND OF THE INVENTION

1. Field of the Invention

The present invention relates to an image forming apparatus with a fixing apparatus for fixing a developer image on a sheet of paper.

2. Description of the Related Art

An image forming apparatus utilizing a digital technique, such as an electronic copying machine, is equipped with a fixing apparatus for fixing, to a sheet of paper, an image of a melted developer by pressure.

The fixing apparatus comprises a heating member for melting a developer, such as toner, and a pressure member for applying a predetermined pressure to the heating member, a predetermined contact width (nip width) being defined between the contact region (nip portion) of the heating and pressure members. When a sheet of paper with an image of a developer melted by the heating member is passed through the nip portion, the image is fixed on the sheet by pressure from the pressure member. In recent years, heating apparatuses have been utilized in which a thin metal conductive layer is formed outside a heating member and is heated using induction heating.

To secure a sufficient nip width between the heating member and the pressure member, the heating member incorporates a roller-shaped elastic member located inside the metal conductive layer. Since the thermal expansion rate of the metal conductive layer is greater than that of the elastic member, the elastic layer will raise from inside the metal conductive layer when they are thermally expanded. As a result, the heating member is hardened, therefore it is difficult to secure a sufficient nip width.

BRIEF SUMMARY OF THE INVENTION

According to an aspect of the present invention, there is provided a fixing apparatus comprising:

a heating member including an elastic member and a metal conductive layer, the elastic member including a central portion of a first outer diameter, and end portions located at opposite ends of the central portion and having a second outer diameter greater than the first outer diameter, the metal conductive layer being located outside the elastic member and including at least one air hole formed therein at a predetermined position opposing the central portion of the elastic member, the air hole connecting an outside to an inside of a heating roller in which the elastic member is located;

a pressure member pressed against the heating member by a pressure mechanism; and a heating mechanism which heats the metal conductive layer using induction heating.

According to another aspect of the present invention, there is provided a fixing apparatus comprising:

a heating member including a hollow shaft member, an elastic member, a cylindrical metal conductive layer and air holes, the elastic member including a central portion of a first outer diameter, and end portions located at opposite ends of the central portion with respective predetermined gaps kept from the central portion and having a second outer diameter greater than the first outer diameter, the metal conductive layer being located outside the elastic member, the air holes being formed through the shaft member at positions corresponding to the gaps between the central portion and the end portions of the elastic member;

a pressure member pressed against the heating member by a pressure mechanism; and a heating mechanism which heats the metal conductive layer using induction heating.

According to a further aspect of the present invention, there is provided a fixing apparatus comprising:

a heating member including a cylindrical elastic member, at least one sheet-like spacer member, a metal conductive layer and an air hole, the spacer member being located outside the elastic member, the metal conductive layer being located outside the elastic member and connected to the spacer member, the air hole being formed at a joint of the spacer member;

a pressure member pressed against the heating member by a pressure mechanism; and a heating mechanism which heats the metal conductive layer using induction heating.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the invention will be described in detail with reference to the accompanying drawings.

Figure 1:
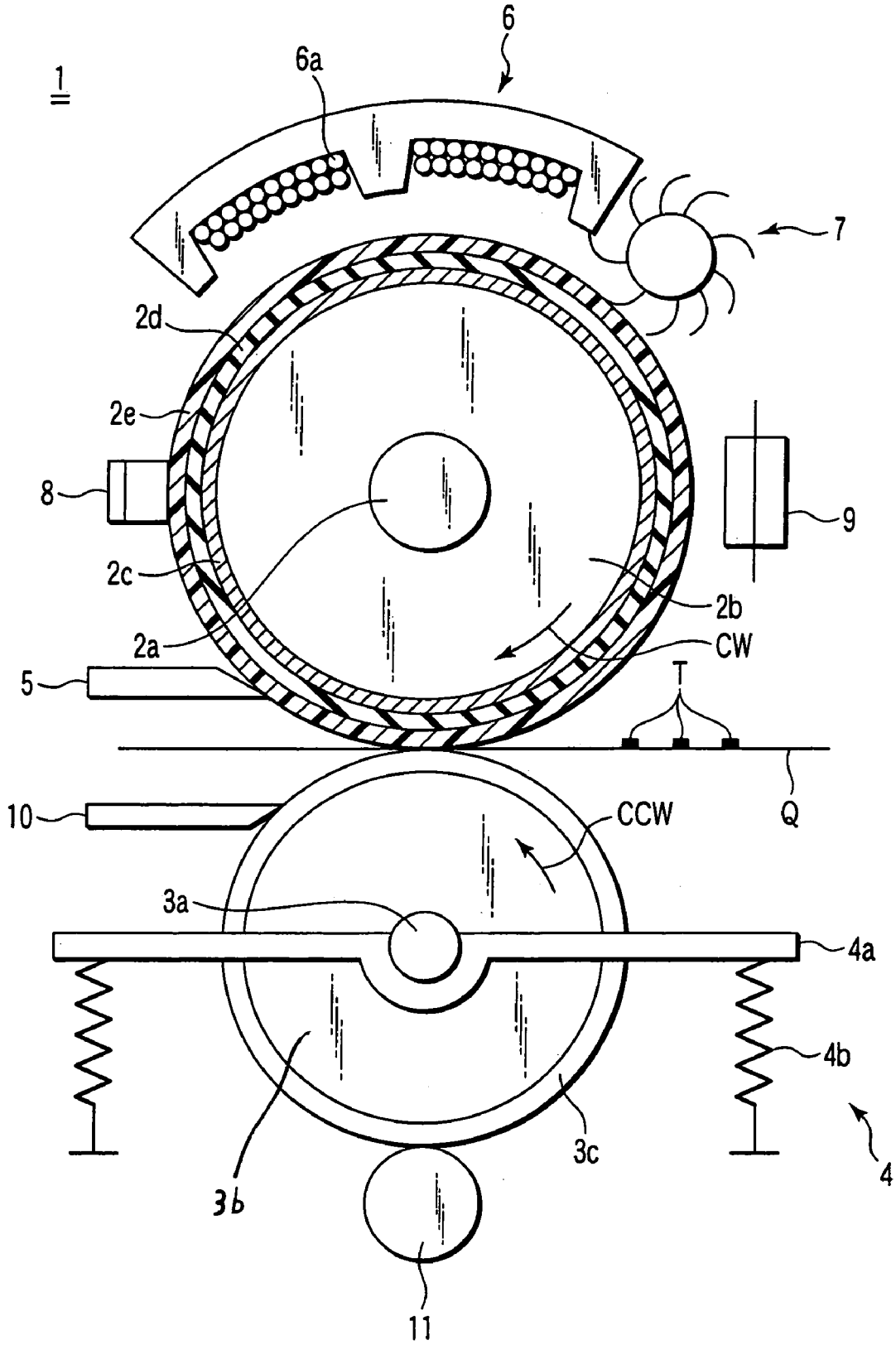
FIG. 1 is a schematic view illustrating an example of a fixing apparatus according to the invention.

FIG. 1 shows an example of a fixing apparatus 1 according to the invention.

As shown in FIG. 1, the fixing apparatus 1 comprises a heating member (heating roller) 2 that can be brought, for heating toner T, into contact with a surface of an image-transferred member, i.e., a paper sheet P, to which toner T sticks. It also comprises a pressure member (pressure roller) 3 for applying a predetermined pressure to the heating roller 1.

The heating roller 2 is fixed to the fixing apparatus 1 at a predetermined position, and provided with a shaft member 2*a*, and an elastic member 2*b*, metal conductive layer 2*c*, primer layer 2*d* and mold-releasing layer 2*e* which are located around the shaft member. The heating roller 2 is rotated by a driving motor (not shown) in the direction indicated by arrow CW. In accordance with the rotation of the heating roller 2, the pressure roller 3 is rotated in the direction indicated by arrow CCW.

In the embodiment, the elastic member 2*b* is formed of, for example, foam rubber acquired by foaming silicon rubber. The metal conductive layer 2*c* is formed of aluminum, nickel, iron, etc. and has a thickness of about 0.5 to 2 mm. The primer layer 2*d* is formed of a heat-resistive adhesive containing silicon, has a thickness of about several microns, and has a function for increasing the adhesion strength of the metal conductive layer 2*c* and the mold-releasing layer. The mold-releasing layer 2*e* is formed about 30 μm thick at the outermost periphery, and is made of a fluorocarbon resin (PFA, PTFE (polytetrafluoroethylene), or a mixture of PFA and PTFE).

The pressure roller 3 comprises a shaft member 3*a*, and an elastic member (of, for example, silicon rubber) 3*b* and mold-releasing layer (of fluorocarbon rubber) 3*c* which are located outside the shaft member. A pressure mechanism (pressure-providing mechanism) 4 presses, using a pressure spring 4*b*, the pressure roller 3 against the heating roller 2 via a bearing member 4*a* connected to the shaft member 3*a*. As a result, a nip portion having a predetermined width (nip width) in the conveyance direction of paper sheets P is formed at the contact portion of the heating roller 2 and pressure roller 3.

Around the heating roller 2, a separation blade 5, induction heating unit 6 and cleaning member 7 are provided in this order downstream of the nip portion of the heating roller 2 and pressure roller 3 with respect to the direction of rotation. The separation blade 5 is used to separate each sheet Q of paper from the heating roller 2. The induction heating unit 6 includes an exciting coil 6*a* and is used to provide a predetermined magnetic field to the metal conductive layer 2*c* of the heating roller 2. The cleaning member 7 is used to remove dust, such as paper particles and offset toner, from the heating roller 2. Further, at least one thermistor 8 for detecting the temperature of the heating roller 2, and at least one thermostat 9 for stopping the supply of heating power to the heating roller when the surface temperature of the heating roller 2 is detected abnormal are provided in the longitudinal direction of the heating roller 2. It is preferable to provide a plurality of thermistors 8 and at least one thermostat 9 in the longitudinal direction of the heating roller 2.

Around the pressure roller 3, a separation blade 10 for separating each paper sheet Q from the pressure roller 3, and a cleaning member 11 for removing toner from the pressure roller 3 are provided.

When a high-frequency current is supplied from an exciting circuit (inverter circuit), now shown, to the exciting coil 6*a* of the induction heating unit 6, the exciting coil 6*a* generates a predetermined magnetic field, whereby an eddy current flows through the metal conductive layer 2*c*. At this time, the metal conductive layer 2*c* generates Joule heat, therefore the heating roller 2 is heated;

Toner T melted by the heat of the heating roller 1 is fixed on a paper sheet Q while the sheet Q with toner T sticking thereto is passed through the nip portion between the heating roller 2 and the pressure roller 3, and a predetermined pressure is applied to the sheet by the pressure roller 3.

As described above, since the fixing apparatus of the invention utilizes induction heating for heating the metal conductive layer 2*c* provided as an outer peripheral surface of the heating roller 2, the apparatus exhibits a small heat loss, i.e., high energy efficiency, and the heating roller 2 can be increased to a predetermined temperature in a short time.

First Embodiment

Figure 2:
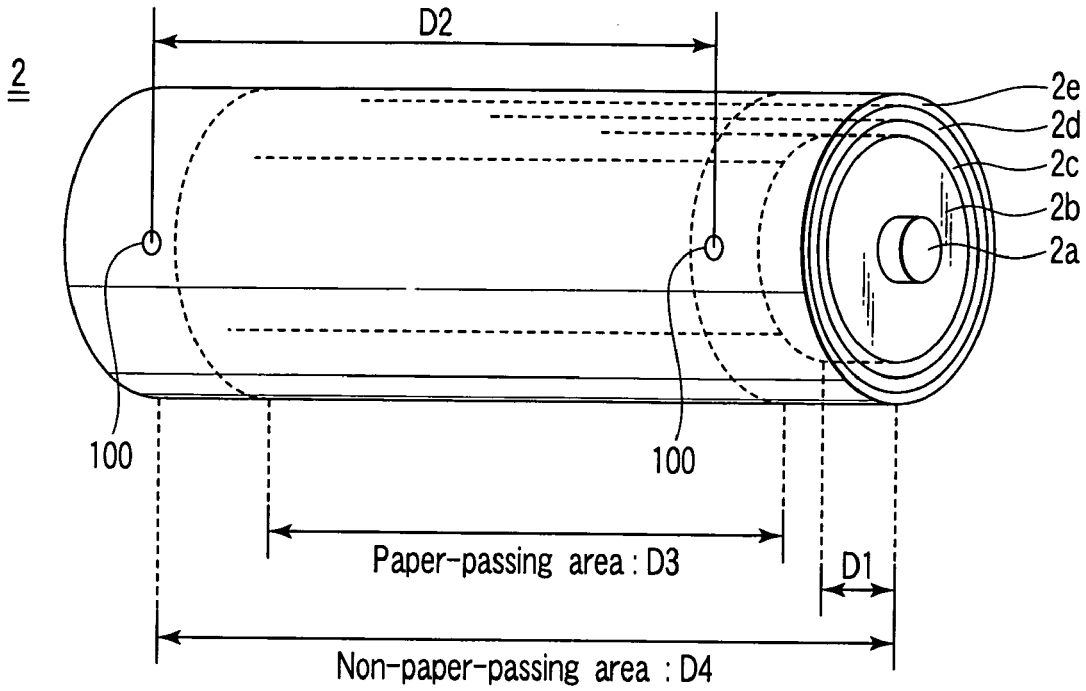
FIG. 2 is a schematic view illustrating the heating member appearing in FIG. 1.
Figure 3:
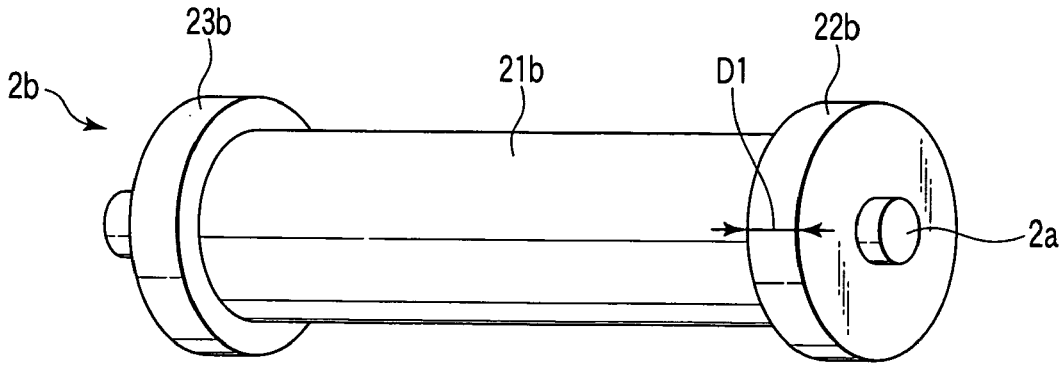
FIG. 3 is a schematic view illustrating an example of an elastic member usable in the heating member shown in FIG. 2.
Figure 4:
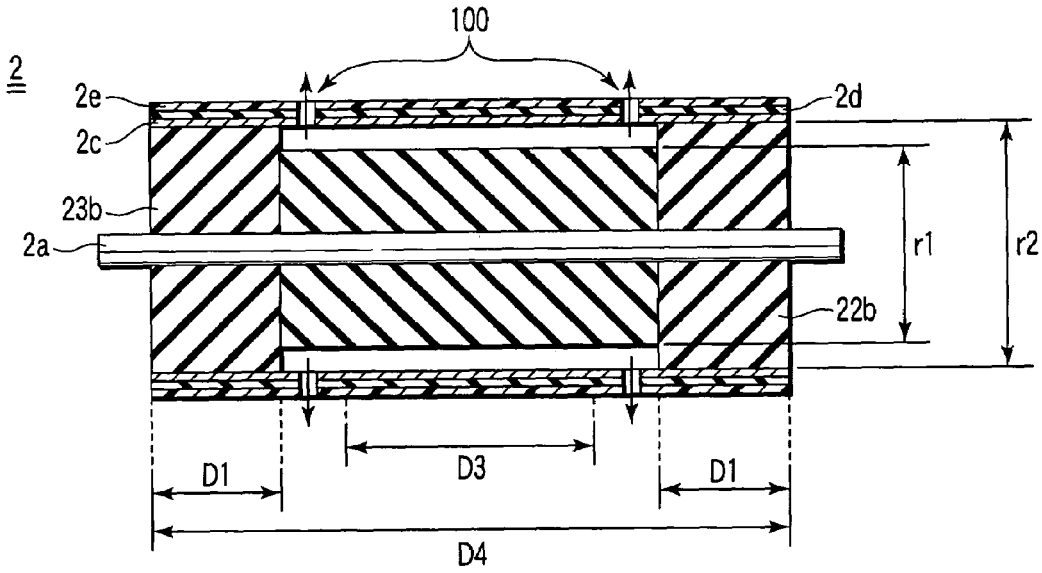
FIG. 4 is a sectional view of the heating member shown in FIG. 2, taken along the axis of the member.

Referring now to FIGS. 2, 3 and 4, a detailed description will be given of an example of the heating roller shown in FIG. 1. FIG. 2 is a schematic view illustrating a heating member applicable to the embodiment. FIG. 3 is a schematic view illustrating an example of the elastic member 2*b* usable in the heating roller 2 of FIG. 2. FIG. 4 is a sectional view of the heating roller 2 of FIG. 2. In these figures, similar elements to those shown in FIG. 1 are denoted by corresponding reference numerals, and no detailed description will be given thereof.

As described above, the heating roller 2 comprises the shaft member 2*a*, elastic member 2*b*, metal conductive layer 2*c*, primer layer 2*d* and mold-releasing layer 2*e*, as is shown in FIG. 2.

As shown in FIG. 3, in the elastic member 2*b*, the axially central portion has a smaller outer diameter than the opposite end portions. Namely, the elastic member 2*b* includes a central portion 21*b* with an outer diameter r1 (see FIG. 4), and end portions 22*b* and 23*b* located at opposite ends of the central portion 21*b* and having an outer diameter r2 (see FIG. 4) larger than the outer diameter r1. The end portions 22*b* and 23*b* have an axial length D1.

Accordingly, as shown in FIG. 4, a clearance is defined between the elastic member 2*b* having its axial diameter varied, and a laminated layer consisting of the metal conductive layer 2*c*, primer layer 2*d* and mold-releasing layer 2*e*.

Further, as shown in FIGS. 2 and 4, air holes 100 are formed through the metal conductive layer 2*c*, primer layer 2*d* and mold-releasing layer 2*e* outside the a paper-passing area D3 and inside the length D1 of the end portions 22*b* and 23*b* of the heating roller 2.

As can be understood from FIG. 4, the air holes 100 connect the clearance between the elastic member 2*b* and metal conductive layer 2*b* to the outside, thereby permitting the air in the clearance to be positively discharged to the outside.

Since the air holes 100 are formed in the non-paper-passing area, each paper sheet Q with an image of toner T do not pass the holes, therefore the image is prevented from being influenced by them.

Thus, when the temperature of the metal conductive layer 2*c* of the heating roller 2 is increased, the air in the heating roller 2 expanded by the heat of the heated layer 2*c* is discharged to the outside through the air holes. This prevents the heating roller 2 from being excessively hardened due to thermal expansion. As a result, a predetermined nip width can be secured between the heating roller 2 and the pressure roller 3, enabling satisfactory image fixing. Thus, the conventional problem that the expanded elastic member 2*b* raises the metal conductive layer 2*c* from inside and increases the hardness of the heating roller 2 is overcome.

In the embodiment, the air holes 100 are substantially circular holes with a radius of 0.1 mm or more, and each pair of air holes are arranged at 180 degree different positions in the opposite end portions of the heating roller. Moreover, in the embodiment, the length D1 of the end portions 22*b* and 23*b* of the elastic member 2*b* is set to 30 mm, and the distance D2 (see FIG. 2) between the longitudinally opposite air holes 100 and 100 is set to 305 mm. Further, the axial length D4 of the non-paper-passing area (i.e., the axial length of the heating roller 2) is set to 385 mm.

The elastic member 2*b* may be formed of a single continuous member. Alternatively, the central portion 21*b* and the end portions 22*b* and 23*b* may be formed of different cylindrical or substantially cylindrical members. In this case, the end portions 22*b* and 23*b* are formed of non-foam silicon rubber (solid rubber). Therefore, the elastic member 2*b* has a higher hardness at the end portions than at the central portion.

Second Embodiment

Figure 5:
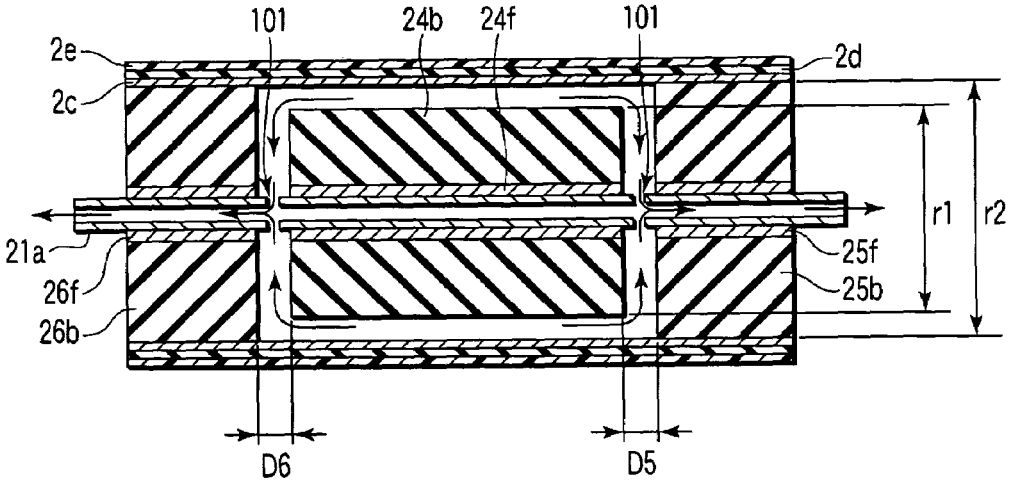
FIG. 5 is a sectional view useful in explaining another example of the heating member shown in FIG. 1.

Referring now to FIG. 5, another example of the heating roller 2 of FIG. 1 will be described in detail. FIG. 5 is a sectional view of the heating member 2 applicable to this embodiment.

As shown in FIG. 5, the heating roller 2 comprises a shaft member 21*a*, elastic members 24*b*, 25*b* and 26*b*, metal conductive layer 2*c*, primer layer 2*d* and mold-releasing layer 2*e*.

The elastic member 24*b* is provided at the axial center of the heating roller 2, and has an outer diameter r1. The elastic members 25*b* and 26*b* are provided at the axially opposite ends of the heating roller 2, and have an outer diameter r2. Accordingly, a clearance is defined between the metal conductive layer 2*c* provided on the outer peripheral surfaces of the elastic members 25*b* and 26*b*, and the elastic member 24*b*. Further, a distance D5 exists between the elastic member 24*b* and the elastic member 25*b*, and a distance D6 exists between the elastic member 24*b* and the elastic member 26*b*. Accordingly, portions of the shaft member 21*a* expose between the elastic member 24*b* and the elastic member 25*b*, and between the elastic member 24*b* and the elastic member 26*b*.

The shaft member 21*a* is a hollow shaft and has air holes 101 between the elastic member 24*b* and the elastic member 25*b*, and between the elastic member 24*b* and the elastic member 26*b*. The air holes 101 connect the interior of the heating roller 2 to the outside, through which the air in the clearance between the metal conductive layer 2*c* and the elastic member 24*b*, and the air contained in the elastic members 24*b*, 25*b* and 26*b* can be positively discharged to the outside.

This being so, when the temperature of the metal conductive layer 2*c* of the heating roller 2 is increased, the thermally expanded air in the heating roller 2 is discharged through the air holes 101, thereby preventing the heating roller 2 from being excessively hardened.

The elastic members 24*b*, 25*b* and 26*b* are formed integrally on the outer peripheral surfaces of base members 24*f*, 25*f* and 26*f*. More specifically, clayey silicon rubber doped with, for example, a foaming agent is applied to a base member coated with primer, and is then foamed like a sponge. The base members 24*f*, 25*f* and 26*f* are fixed to the outer periphery of the shaft member 21*a* by fixing members (not shown). The fixing members may be formed of a heat-resistive adhesive, screws, etc. The fixing members enable the elastic members 24*b*, 25*b* and 26*b* to be rotated together with the shaft member 21*a*. Since the elastic members 24*b*, 25*b* and 26*b* are members independent of each other, they can be easily formed to desired diameters. Further, when forming an elastic member in which the central portion has a diameter different from that of the other portions as in the embodiment, the working process can be more simplified than in the case of forming the central portion by cutting.

In this embodiment, the outer diameter r1 of the elastic member 24*b* is set to 44 mm, that r2 of the elastic members 25*b* and 26*b* is set to 45 mm, and the distance D5 between the elastic members 24*b* and 25*b* and that D6 between the elastic members 24*b* and 26*b* are set to 2 mm. Further, in the embodiment, the air holes 101 are substantially circular holes, and each pair of air holes are arranged at 180 degree different positions. The arrangement is not limited to this. A plurality of air holes may be formed in a predetermined area if the shaft member 21*a* can have a sufficient strength. The elastic member 24*b* is formed of foam rubber acquired by foaming, for example, silicon rubber, while the elastic members 25*b* and 26*b* are formed of non-foam silicon rubber (solid rubber). Accordingly, the elastic member 2*b* has a higher hardness at the end portions than at the central portion. However, the invention is not limited to this structure, but all the elastic members 24*b*, 25*b* and 26*b* may be formed of foam rubber. The base members 24*f*, 25*f* and 26*f* may have a cross section other than a circular section, so as to define a gap between them and the shaft member 21*a*.

Third Embodiment

Figure 6:
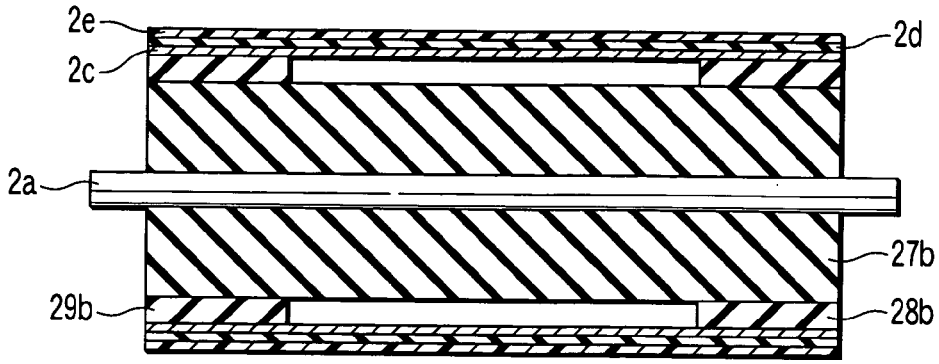
FIG. 6 is a sectional view useful in explaining yet another example of the heating member shown in FIG. 1.
Figure 7:
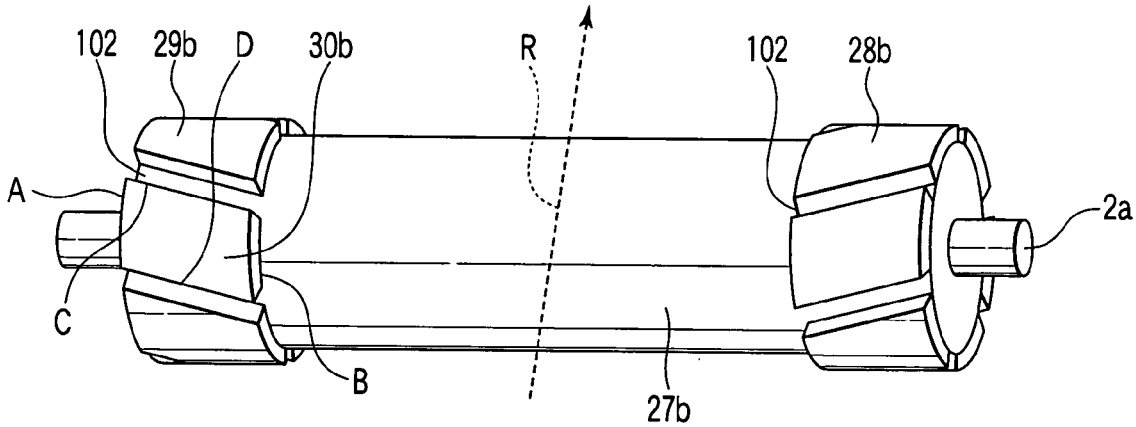
FIG. 7 is a schematic view illustrating an example of an elastic member usable in the heating member shown in FIG. 6.
Figure 8:
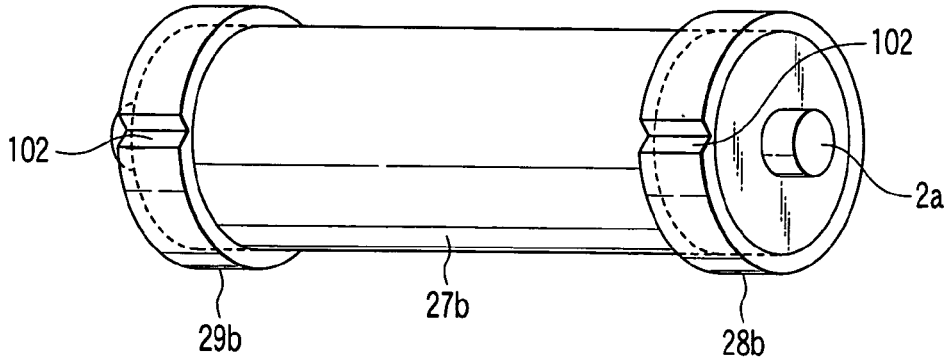
FIG. 8 is a schematic view illustrating another example of the elastic member usable in the heating member shown in FIG. 6.

Referring to FIGS. 6, 7 and 8, a detailed description will be given of yet another example of the heating roller 2 shown in FIG. 1. FIG. 6 is a sectional view of a heating member 2 according to a third embodiment. FIG. 7 is a schematic view illustrating an example of an elastic member usable in the heating member shown in FIG. 6. FIG. 8 is a schematic view illustrating another example of the elastic member usable in the heating member shown in FIG. 6.

As shown in FIG. 6, the heating roller 2 comprises a shaft member 2*a*, elastic member 27*b*, metal conductive layer 2*c*, primer layer 2*d* and mold-releasing layer 2*e*.

The elastic member 27*b* is a cylindrical member having an axially constant outer diameter. Spacers 28*b* and 29*b* are provided on the respective outer peripheral surfaces of the opposite end portions of the elastic member 27*b*. More specifically, the spacers 28*b* and 29*b* are provided between the elastic member 27*b* and the metal conductive layer 2*c*, thereby defining a clearance between them.

The spacers 28*b* and 29*b* are formed of, for example, a plurality of sheet members 30*b* as shown in FIG. 7, and linear air holes 102 inclined by a predetermined angle with respect to the axis are formed between the sheet members 30*b*.

Each sheet member 30*b* is substantially in the shape of a lozenge, and has opposing sides A and B located in the circumferential direction of the heating roller 2, and opposing sides C and D inclined by a predetermined angle with respect to the axis thereof. The air holes 102 are used to discharge, to the outside, the air in the heating roller 2. These air holes are defined between the elastic member 27*b* and the metal conductive layer 2*c* when the spacers 28*b* and 29*b* are adhered to the metal conductive layer 2*c* by, for example, an adhesive, and can positively discharge the air contained therein to the outside.

Therefore, the air in the heating roller 2 thermally expanded when the temperature of the metal conductive layer 2*c* of the heating roller 2 is increased is discharged to the outside through the air holes 102. This prevents the heating roller 2 from being excessively hardened.

The invention may be constructed as described above such that a plurality of air holes 102 are formed using a plurality of sheet members 30*b*, or may employ spacers 28*b* and 29*b* each formed of a single sheet member as shown in FIG. 8.

In the latter case, the spacers 28*b* and 29*b* wound on the outer peripheral surface of the elastic member 27*b* each have an air hole 102 defined between the ends of the single sheet member coupled in the winding direction (i.e., in the circumferential direction of the heating roller 2). Namely, each sheet member forming the spacers 28*b* and 29*b* has long sides each shorter than the circumferential length of the elastic member 27*b*, and short sides that define the air hole 102 therebetween.

As described above, by forming the spacers 28*b* and 29*b* using respective sheet members as shown in FIG. 8, the working process can be simplified. Further, by forming a plurality of air holes 102 as shown in FIG. 7, the air in the heating roller 2 can be more positively discharged to the outside.

In addition, as shown in FIG. 7, the air holes 102 inclined by the predetermined angle with respect to the axis are formed symmetrical with respect to an imaginary line R that extends perpendicular to the axis of the heating roller 2 in the paper-passing direction. The angle by which the air hole 102 formed in one of the spacers, e.g., spacer 29*b*, is inclined is the angle acquired by subtracting, from 180 degrees, the angle by which the air hole 102 formed in the other spacer 28*b* is inclined. Further, the heating roller 2 is arranged such that each paper sheet Q is passed in the direction indicated by the arrow of the imaginary line R. Accordingly, in the fixing apparatus of this embodiment, each paper sheet Q is moved while it is tensed toward the opposite ends of the heating roller 2, which makes it difficult to form, for example, wrinkles on each paper sheet Q.

In the embodiment, the spacers 28*b* and 29*b* have a thickness of 0.5 mm and are formed of silicon rubber (solid rubber). However, the invention is not limited to this, but the spacers 28*b* and 29*b* may be formed of the same material as the elastic member 27*b*. Alternatively, they may be formed of a material that is not easily influenced by thermal deformation, i.e., thermal contraction, thermal expansion, etc., for instance, a material containing a resin, such as polyimide, or containing the same metal as the metal conductive layer 2*c*.

This being so, as described above, when a heating roller is heated utilizing induction heating of high energy efficiency that can quickly heat the surface temperature of the heating roller to a set temperature, the air in the heating roller 2, contained in, for example, the elastic member, can be positively discharged to the outside. This can be said of even a heating roller provided with a thin metal conductive layer and an elastic member located inside it and having a thermal expansion rate different from that of the metal conductive layer. Therefore, the heating roller 2 is prevented from being excessively hardened. Accordingly, a predetermined nip width can be secured between the heating roller 2 and the pressure roller 3, thereby enabling satisfactory image fixing.

The invention is not limited to the above-described embodiments, but may be modified in various ways without departing from the scope. Various inventions can be realized by appropriately combining structural elements disclosed in the embodiments. For example, some may be deleted from the structural elements of the embodiments. Furthermore, some of the structural elements disclosed in different embodiments may be appropriately combined.

Specifically, although, in the case of FIG. 2, the elastic member 2*b* comprises the central portion 21*b* with the outer diameter r1, and the end portions 22*b* and 23*b* with the outer diameter r2, the invention is not limited to this. Alternatively, the elastic member may have such a structure as employed in the third embodiment shown in FIGS. 6 to 8, in which spacers that make, r2, the outer diameter of the end portions of the elastic member having the same outer diameter r1 over its length are provided on the end portions of the elastic member.

Further, such air holes 102 as shown in FIGS. 7 and 8 may be formed in the end portions 22*b* and 23*b* of the elastic member 2*b* shown in FIGS. 2 to 4, or in the elastic members 25*b* and 26*b* shown in FIG. 5.

What is claimed is:

1. A fixing apparatus comprising:

a heating member including an elastic member and a metal conductive layer, the elastic member including a central portion of a first outer diameter, and end portions located at opposite ends of the central portion and having a second outer diameter greater than the first outer diameter, the metal conductive layer being located outside the elastic member and contacting outer peripheries of the end portions of the elastic member, and a space being defined between the metal conductive layer and the central portion of the elastic member, the metal conductive layer including at least one air hole formed therein at a predetermined position opposing the central portion of the elastic member, the air hole connecting an outside of a heating roller to the space;

a pressure member pressed against the heating member by a pressure mechanism; and a heating mechanism which heats the metal conductive layer using induction heating.

2. The fixing apparatus according to claim 1, wherein the heating member also includes at least a mold-releasing layer formed on an outer periphery of the metal conductive layer integrally with the metal conductive layer, and the air hole extending at least through the mold-releasing layer.

3. The fixing apparatus according to claim 1, wherein the end portions are formed of members different from a member of the central portion, and has a higher hardness than the central portion.

4. A fixing apparatus comprising:

a heating member including a hollow shaft member, an elastic member, a cylindrical metal conductive layer and air holes, the elastic member including a central portion of a first outer diameter, and end portions located at opposite ends of the central portion with respective predetermined gaps kept from the central portion and having a second outer diameter greater than the first outer diameter, the metal conductive layer being located outside the elastic member and contacting outer peripheries of the end portions of the elastic member, and a space being defined between the metal conductive layer and the central portion of the elastic member, the air holes being formed through the shaft member at positions corresponding to the gaps between the central portion and the end portions of the elastic member and communicating with the space;

a pressure member pressed against the heating member by a pressure mechanism; and a heating mechanism which heats the metal conductive layer using induction heating.

5. The fixing apparatus according to claim 4, wherein the end portions are formed of members different from a member of the central portion, and has a higher hardness than the central portion.

6. The fixing apparatus according to claim 4, wherein a gap of not less than 0.5 mm is defined in an axial direction between the central portion and each of the end portions.

7. The fixing apparatus according to claim 4, wherein the air holes are formed substantially circularly and have a diameter of not less than 0.1 mm.

8. The fixing apparatus according to claim 4, wherein the central portion and the end portions of the elastic member are formed integrally with base members provided between the shaft member and each of the central portion and the end portions.

9. A fixing apparatus comprising:

a heating member including a cylindrical elastic member, at least one sheet-like spacer member, a metal conductive layer and an air hole, the spacer member being located outside the elastic member, the metal conductive layer being located outside the elastic member and connected to the spacer member, the air hole being formed at a joint of the spacer member;

a pressure member pressed against the heating member by a pressure mechanism; and a heating mechanism which heats the metal conductive layer using induction heating.

10. The fixing apparatus according to claim 9, wherein the air hole is a linear hole inclined by a predetermined angle with respect to an axis of the heating member.

11. A fixing apparatus comprising:

a heating member including an elastic member and a metal conductive layer, the elastic member including a central portion of a first outer diameter, and end portions located at opposite ends of the central portion and having a second outer diameter greater than the first outer diameter, the end portions being formed of members different from a member of the central portion and having a higher hardness than the central portion, the metal conductive layer being located outside the elastic member and including at least one air hole formed therein at a predetermined position opposing the central portion of the elastic member, the air hole connecting an outside to an inside of a heating roller in which the elastic member is located;

a pressure member pressed against the heating member by a pressure mechanism; and a heating mechanism which heats the metal conductive layer using induction heating.

12. A fixing apparatus comprising:

a heating member including a hollow shaft member, an elastic member, a cylindrical metal conductive layer and air holes, the elastic member including a central portion of a first outer diameter, and end portions located at opposite ends of the central portion with respective predetermined gaps kept from the central portion and having a second outer diameter greater than the first outer diameter, the end portions being formed of members different from a member of the central portion and having a higher hardness than the central portion, the metal conductive layer being located outside the elastic member, the air holes being formed through the shaft member at positions corresponding to the gaps between the central portion and the end portions of the elastic member;

a pressure member pressed against the heating member by a pressure mechanism; and a heating mechanism which heats the metal conductive layer using induction heating.

13. A fixing apparatus comprising:

a heating member including a cylindrical elastic member, spacers provided on respective outer peripheral surfaces of opposite end portions of the elastic member, and a metal conductive layer located outside the elastic member and contacting outer peripheries to the spacers, a space being defined between the metal conductive layer and a central portion of the elastic member;

a pressure member pressed against the heating member by a pressure mechanism; and a heating mechanism which heats the metal conductive layer using induction heating.

14. The fixing apparatus according to claim 13, wherein at least one of the spacers has an air hole communicating the space with an outside of the heating member.

15. The fixing apparatus according to claim 14, wherein the air hole extends in a direction parallel to an axis of the heating member.

16. The fixing apparatus according to claim 14, wherein the air hole is a linear hole inclined by a predetermined angle with respect to an axis of the heating member.

17. The fixing apparatus according to claim 14, wherein each of the spacers has an air hole communicating the space with an outside of the heating member.

18. The fixing apparatus according to claim 14, wherein each of the spacers has a plurality of air holes communicating the space with an outside of the heating member.

* * * * *